US010813432B1

(12) United States Patent
Zhang et al.

(10) Patent No.: US 10,813,432 B1
(45) Date of Patent: Oct. 27, 2020

(54) CHILD RESISTANT LIP PRODUCT MATERIAL DISPENSER

(71) Applicant: 14th Round Incorporated, Los Angeles, CA (US)

(72) Inventors: Kevin Zhang, Changzhou (CN); Jeremy Green, Pacific Palisades, CA (US); Alex Clulee, Algester (AU)

(73) Assignee: 14TH ROUND INCORPORATED, Los Angeles, CA (US)

( * ) Notice: Subject to any disclaimer, the term of this patent is extended or adjusted under 35 U.S.C. 154(b) by 0 days.

(21) Appl. No.: 16/708,126

(22) Filed: Dec. 9, 2019

(51) Int. Cl.
*B43K 21/08* (2006.01)
*A45D 40/06* (2006.01)
*A45D 40/12* (2006.01)

(52) U.S. Cl.
CPC ..... *A45D 40/06* (2013.01); *A45D 40/065* (2013.01); *A45D 40/12* (2013.01)

(58) Field of Classification Search
CPC ..... A45D 40/06; A45D 40/065; A45D 40/12
USPC ..... 401/75, 83, 84
See application file for complete search history.

(56) References Cited

U.S. PATENT DOCUMENTS 5,769,252 A * 6/1998 Volpe ..... B65D 50/041 215/201
8,235,616 B2 * 8/2012 Raccah ..... B65D 50/041 401/126
9,586,738 B2 * 3/2017 Herrbach ..... B65D 41/3409

* cited by examiner

*Primary Examiner* — Jennifer C Chiang
(74) *Attorney, Agent, or Firm* — Flener IP & Business Law; Zareefa B. Flener; Ayhan E. Mertogul

(57) ABSTRACT

A child resistant lip product material dispenser comprises a body having a first opening at a first end and external threads disposed on an external surface of the body proximate the first end. A rotary module has first internal threads configured to engage with the external threads, and a lid is disposed on the rotary module. A lip product material is at least partially disposed within the body. The rotary module further comprises a first plurality of spaced teeth arranged in a circular pattern on a surface of the rotary module facing the lid, and the lid comprises a second plurality of spaced teeth arranged in a circular pattern on a surface of the lid facing the rotary module, wherein the first and second pluralities of spaced teeth are configured to mesh together.

19 Claims, 2 Drawing Sheets

CHILD RESISTANT LIP PRODUCT MATERIAL DISPENSER

FIELD OF THE INVENTION

The present invention relates to a lip product material dispenser. More specifically, the present invention relates to a child resistant lip product material dispenser for preventing children from accessing the lip product material therein.

BACKGROUND

In the current application the phrase "lip product material" refers to any lip product material, for example without limitation including lipsticks, lip balms, lip protecting oils, and other lip product materials dispensed from a lip product material dispenser. In recent years there has been an increasing number of lip product materials being sold in a vast assortment of colors, textures, and flavors. There has also been an increased occurrence of accidental poisoning of children gaining access to the lip product material dispensers.

Child resistant lip product material dispensers are known in the art. For example, JPH11124154A discloses a mechanism including a sliding sleeve 14 and bending fingers 8. In a first position the sliding sleeve 14 prevents the bending fingers 8 from bending, thereby trapping a container 5 and preventing the container 5 from being pulled out of a cap 11. In a second position, the sliding sleeve 14 is slid relative to the cap 11, thereby releasing the bending fingers 8 allowing their bending, which allows the container 5 to be pulled out of the cap 11.

In another example, JPH11130111A discloses a mechanism including ramped surfaces on a cap element 10 of a cap 7, and blocking parts 12. In a first position the blocking parts 12 prevent withdrawal of a container 5 from the cap 7. However, when pressure is applied to a top of the cap 7 the ramped surfaces on the cap element 10 push the blocking parts 12 outwardly allowing the container 5 to be pulled out of the cap 7.

Known prior art child resistant lip product material dispensers including the examples cited above, include child resistant mechanisms requiring only one action to defeat the mechanism, fix example, pushing or pulling on a part of the mechanism. Therefore, known prior art child resistant lip product material dispensers are easily defeated and insufficient to the task of preventing a child from accessing the lip product material disposed therein. A need therefore exists for a lip product material dispenser having child resistant features requiring multiple coordinated actions to open the dispenser.

SUMMARY OF THE INVENTION

According to one aspect of the invention, a child resistant lip product material dispenser comprises a body having a first opening at a first end and external threads disposed on an external surface of the body proximate the first end. A rotary module has first internal threads configured to engage with the external threads, and a lid is disposed on the rotary module. A lip product material is at least partially disposed within the body. The rotary module further comprises a first plurality of spaced teeth arranged in a circular pattern on a surface of the rotary module facing the lid, and the lid comprises a second plurality of spaced teeth arranged in a circular pattern on a surface of the lid facing the rotary module, wherein the first and second pluralities of spaced teeth are configured to mesh together.

According to another aspect of the invention, a child resistant lip product material dispenser comprises a body having a first opening at a first end, external threads disposed on an external surface of the body proximate the first open end, and a guide block disposed at least partially within the body. A rotary module has first internal threads configured to engage with the external threads, and a lid is disposed on the rotary module. The rotary module further comprises a first plurality of spaced teeth arranged in a circular pattern on a surface of the rotary module facing the lid, and the lid comprises a second plurality of spaced teeth arranged in a circular pattern on a surface of the lid facing the rotary module, wherein the first and second pluralities of spaced teeth are configured to mesh together.

According to a further aspect of the invention, a child resistant lip product material dispenser comprises a body having a first opening at a first end and a second opening at a second end and external threads disposed on an external surface of the body proximate the first end. An end cap has an elongate portion configured to extend into the body through the second opening, wherein the elongate portion comprises an at least partially externally threaded portion. A guide block has first internal threads configured to engage with the at least partially externally threaded portion. A rotary module has second internal threads configured to engage with the external threads, and a lid is disposed on the rotary module. The rotary module further comprises a first plurality of spaced teeth arranged in a circular pattern on a surface of the rotary module facing the lid, and the lid comprises a second plurality of spaced teeth arranged in a circular pattern on a surface of the lid facing the rotary module, wherein the first and second pluralities of spaced teeth are configured to mesh together.

BRIEF DESCRIPTION OF THE DRAWINGS

Other aspects and advantages of the present invention will become apparent upon consideration of the following detailed description, wherein similar structures have similar reference numerals.

DETAILED DESCRIPTION

The following detailed embodiments presented herein are for illustrative purposes. That is, these detailed embodiments are intended to be exemplary of the present invention for the purposes of providing and aiding a person skilled in the pertinent art to readily understand how to make and use the present invention.

Figure 1:
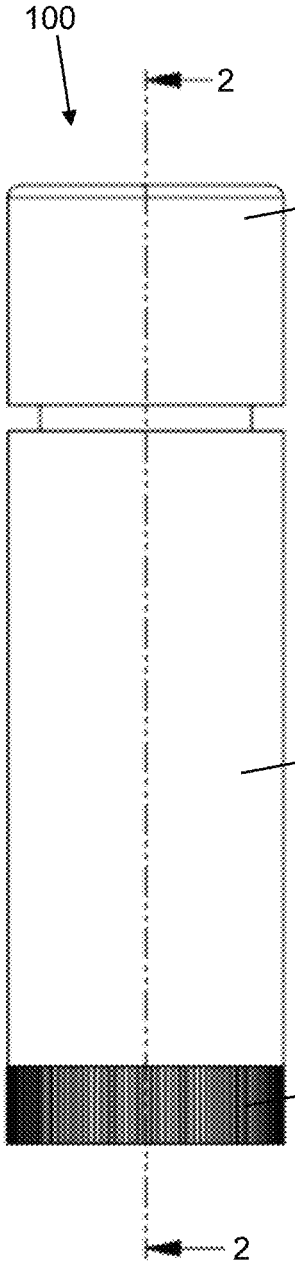
FIG. 1 is a side elevational view of an embodiment of a lip product material dispenser.
Figure 2:
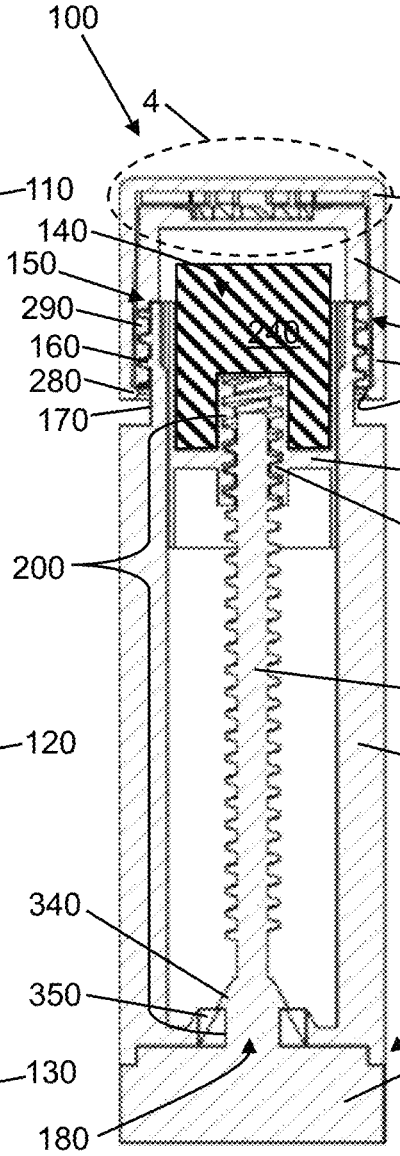
FIG. 2 is a cross-sectional view of the lip product material dispenser taken along the line 2-2 in FIG. 1.

Referring to FIG. 1, an external view of an embodiment of a child resistant lip product material dispenser 100 is illustrated. In one embodiment the dispenser 100 when viewed externally comprises a lid 110, a body 120, and an end cap 130. FIG. 2 illustrates further internal components and features of the dispenser 100 in a cross-section of the dispenser 100, and FIG. 3 illustrates an exploded view of the components of the dispenser 100.

Figure 3:
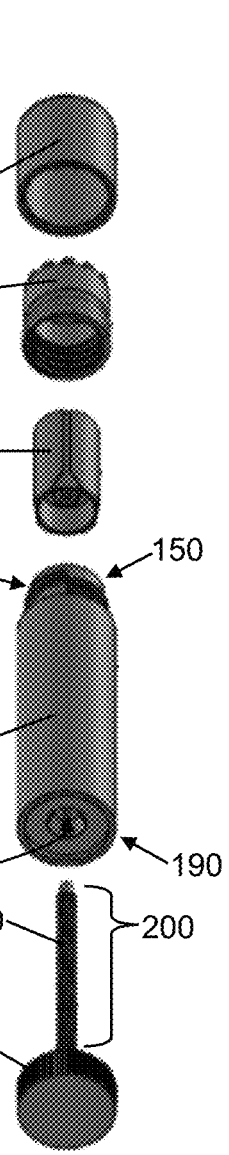
FIG. 3 is an exploded view of an embodiment of a lip product material dispenser.

Referring to FIGS. 2 and 3, in one embodiment the body 120 comprises a first opening 140 at a first end 150 thereof. The body 120 further comprises external threads 160 disposed on an external surface 170 of the body 120 proximate the first end 150 thereof. In one embodiment the body 120 further comprises a second opening 180 at a second end 190 thereof. In one embodiment the end cap 130 comprises an elongate portion 200 configured to extend into the body 120 through the second opening 180, wherein the elongate portion 200 comprises an at least partially externally threaded portion 210. In one embodiment a guide block 220 is disposed at least partially within the body 120, for example, on the elongate portion 200. The guide block 220 comprises internal threads 230 configured to engage with the at least partially externally threaded portion 210. In one embodiment a lip product material 240 is disposed at least partially within the body 120 on the guide block 220. In one embodiment a rotary module 250 is disposed within the lid 110.

Figure 4A:
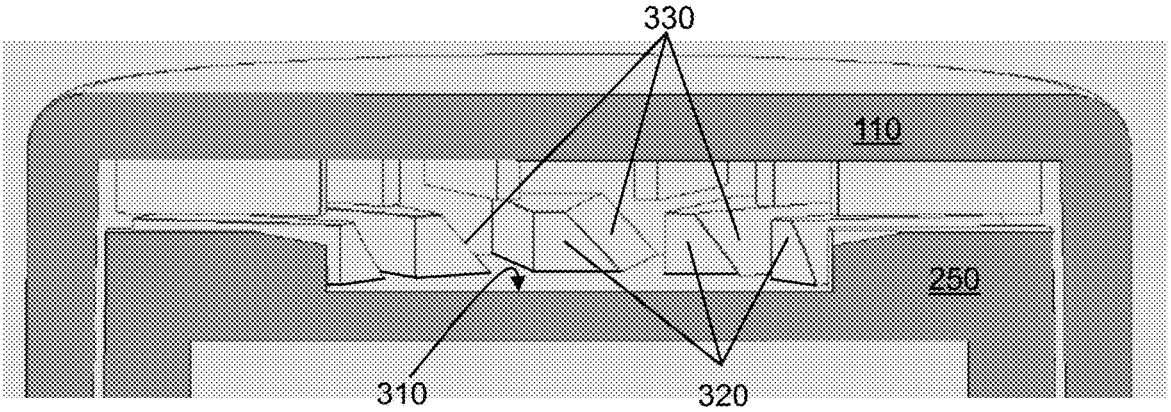
FIG. 4A is an enlarged portion of the cross-sectional view of FIG. 2 showing facing structures of the lid and rotary module tilted slightly downwardly.
Figure 4B:
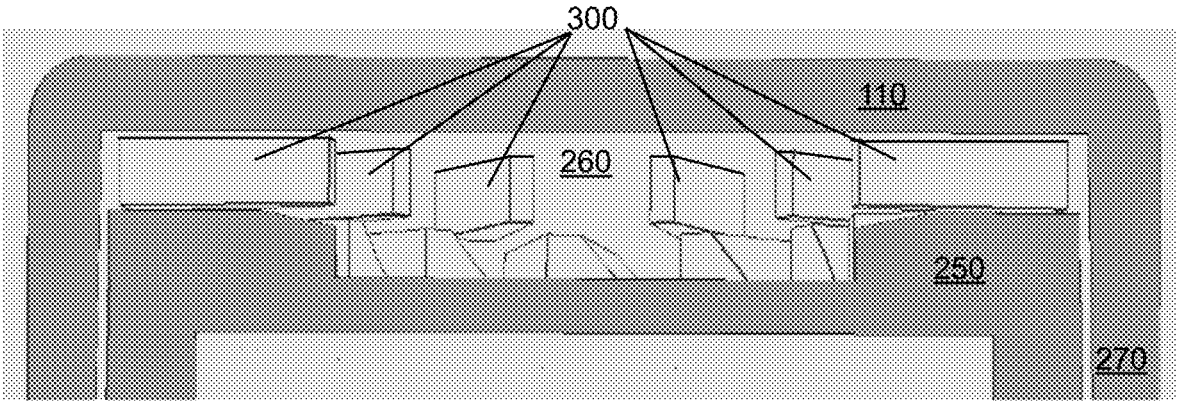
FIG. 4B is an enlarged portion of the cross-sectional view of FIG. 2 showing facing structures of the lid and rotary module tilted slightly upwardly.

Referring to FIGS. 4A and 4B, an enlarged view of the region encircled by the dashed oval 4 in FIG. 2 is illustrated. FIG. 4A illustrates the region tilted slightly downwardly and FIG. 4B illustrates the region tilted slightly upwardly. Referring to FIG. 4B, in one embodiment the lid 110 is disposed on the rotary module 250 and comprises an internal surface 260 that faces the rotary module 250. In one embodiment the lid 110 comprises an annular skirt 270 depending from the surface 260. Referring back to FIG. 2, in one embodiment a free end of the annular skirt 270 comprises a lip 280 that extends radially inward. In one embodiment an inner radius R1 of the lip 280 has a smaller dimension than an outer dimension R2 of the rotary module 250 so that the rotary module 250 is retained within the lid 110. The rotary module 250 comprises internal threads 290 configured to engage with the external threads 160 disposed on the external surface 170 of the body 120 proximate the first end 150 thereof.

Referring again to FIGS. 4A and 4B, the lid 110 comprises a plurality of spaced teeth 300 arranged in a circular pattern on the surface 260. The rotary module 250 comprises a surface 310 that faces the lid 110. In one embodiment the rotary module 250 comprises a plurality of spaced teeth 320 arranged in a circular pattern on the surface 310. In one embodiment the plurality of spaced teeth 300 is configured to mesh together with the plurality of spaced teeth 320. As shown best in FIG. 4A, in one embodiment each of the plurality of spaced teeth 320 comprises a ramped surface 330 facing the lid 110. In one embodiment each of the ramped surfaces 330 is oriented to face circumferentially clockwise relative to the circular pattern as viewed by an observer positioned in the direction of the lid 110.

In operation, the lid 110 is disposed on the rotary module 250 so that the rotary module 250 is retained within the lid 110 but is free to move toward or away from the lid 110 so that the pluralities of spaced teeth 300, 320 can mesh together or can unmesh from one another, respectively. When the pluralities of spaced teeth 300, 320 are meshed together rotation of the lid 110 clockwise as viewed by an observer positioned above the lid 110 causes the rotary module 250 to also rotate clockwise. In one embodiment the external threads 160 are right handed threads, so rotation of the rotary module 250 in a clockwise direction when viewed from above causes the rotary module 250 to further engage with the body 120 and ultimately to be tightly engaged thereupon.

In the tightly engaged condition a counterclockwise rotation of the rotary module 250 is required to loosen and ultimately remove the rotary module 250 from the body 120. However, unlike the operation for tightening the rotary module 250 onto the body 120 described above, when the pluralities of spaced teeth 300, 320 are meshed together simple rotation of the lid 110 counterclockwise as viewed by an observer positioned above the lid 110 does not cause the rotary module 250 to also rotate in the counterclockwise sense. Instead, when the pluralities of spaced teeth 300, 320 are meshed together simple rotation of the lid 110 counterclockwise causes the plurality of teeth 300 to ride up the ramps 330 until the plurality of teeth 300 unmeshes and disengages from the plurality of teeth 320.

A second action in addition to counterclockwise rotation of the lid 110 is required to cause the rotary module 250 to also rotate counterclockwise. The second required action is application of a force on the lid 150 toward the body 120 sufficient to prevent the plurality of teeth 300 from riding up the ramps 330 and unmeshing from the plurality of teeth 320 during counterclockwise rotation of the lid 150. Without being bound by theory, the actual amount of force required to keep the pluralities of spaced teeth 300, 320 meshed during counterclockwise rotation would depend upon several factors likely including the number and spacing of the pluralities of spaced teeth 300, 320, the angle of the ramps 330 relative to the surface 310, and the coefficient of static friction between the ramps 330 and the plurality of spaced teeth 300.

Referring again to FIG. 2, in another aspect of operation of the dispenser 100, in one embodiment rotation of the end cap 130 relative to the body 120 translates the guide block 220 axially along the elongate portion 200. Thus, once the lid 110 has been removed from the body 120 a user may extend the lip product material 240 a desired distance out of the body 120 for application. In one embodiment the elongate portion 200 of the end cap 130 comprises a radially outwardly extending member 340, wherein an outer dimension of the radially outwardly extending member 340 has a larger dimension than an inner dimension of the second opening 180. In one embodiment the end cap 130 is held on the body 120 by radially innermost projections 350 that block outward axial motion of radially outwardly extending member 340. In one embodiment the end cap 130 is attached to the body 120 during manufacture by being pushed into the body 120 until the radially outwardly extending member 340 snaps past the radially innermost projections 350.

It should be noted that the appearance and size of the lip product material dispenser 100 and its components as described hereinabove can be adjusted according to different capacities for the lip product material without altering the structures and functional relationships of the components described herein. Those skilled in the art will appreciate that the invention described herein is susceptible to variations and modifications other than those specifically described, and that each embodiment is also provided with features that may be applicable to other embodiments. It is to be understood that the invention includes all such variations and modifications that fall within its spirit and scope. The invention also includes all the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

INDUSTRIAL APPLICABILITY

A child resistant lip product material dispenser comprises child resistant features requiring multiple coordinated actions to open the dispenser, thus effectively preventing children from opening the lip product material dispenser and accessing to the lip product material therein. The child resistant lip product material dispenser can be manufactured in industry for use by consumers.

Numerous modifications to the present invention will be apparent to those skilled in the art in view of the foregoing description. It is not desired to limit the invention to the exact construction and operation shown and described, and accordingly, all suitable modifications and equivalents may be resorted to, falling within the scope of the invention. Accordingly, this description is to be construed as illustrative only of the principles of the invention and is presented for the purpose of enabling those skilled in the art to make and use the invention and to teach the best mode of carrying out same. The exclusive rights to all modifications which come within the scope of the appended claims are reserved. All patents, patent publications and applications, and other references cited herein are incorporated by reference herein in their entirety.

We claim:

1. A child resistant lip product material dispenser, comprising:

a body having a first opening at a first end and external threads disposed on an external surface of the body proximate the first end;

a rotary module having first internal threads configured to engage with the external threads;

a lid disposed on the rotary module; and lip product material at least partially disposed within the body; wherein the rotary module further comprises a first plurality of spaced teeth arranged in a circular pattern on a surface of the rotary module facing away from the body, and the lid comprises a second plurality of spaced teeth arranged in a circular pattern on a surface of the lid facing toward the body; wherein the first and second pluralities of spaced teeth are configured to mesh together; and wherein each of the first plurality of spaced teeth comprises a ramped surface facing away from the body.

2. The child resistant lip product material dispenser of claim 1, wherein each of the ramped surfaces is oriented to face circumferentially clockwise relative to the circular pattern.

3. The child resistant lip product material dispenser of claim 2, wherein the external threads are right handed threads.

4. The child resistant lip product material dispenser of claim 1, wherein the body further comprises a second opening at a second end and the child resistant lip product material dispenser further comprises:

an end cap having an elongate portion configured to extend into the body through the second opening, wherein the elongate portion comprises an at least partially externally threaded portion; and a guide block having second internal threads configured to engage with the at least partially externally threaded portion; wherein the lip product material is disposed on the guide block.

5. The child resistant lip product material dispenser of claim 4, wherein rotation of the end cap relative to the body translates the guide block axially along the elongate portion.

6. The child resistant lip product material dispenser of claim 4, wherein the elongate portion comprises a radially outwardly extending member, wherein an outer dimension of the radially outwardly extending member has a larger dimension than an inner dimension of the second opening.

7. The child resistant lip product material dispenser of claim 1, wherein the lid further comprises an annular skirt depending from the surface of the lid, a free end of the annular skirt comprises a lip that extends radially inward, and an inner radius of the lip has a smaller dimension than an outer dimension of the rotary module.

8. A child resistant lip product material dispenser, comprising:

a body having a first opening at a first end and first external threads disposed on an external surface of the body proximate the first open end;

a guide block disposed at least partially within the body, wherein the guide block comprises first internal threads configured to engage with second external threads of an elongate portion of an end cap;

a rotary module having second internal threads configured to engage with the first external threads; and a lid disposed on the rotary module; wherein the rotary module further comprises a first plurality of spaced teeth arranged in a circular pattern on a surface of the rotary module facing the lid, and the lid comprises a second plurality of spaced teeth arranged in a circular pattern on a surface of the lid facing the rotary module; and wherein the first and second pluralities of spaced teeth are configured to mesh together.

9. The child resistant lip product material dispenser of claim 8, wherein each of the first plurality of spaced teeth comprises a ramped surface facing the lid, wherein each of the ramped surfaces is oriented to face circumferentially clockwise relative to the circular pattern.

10. The child resistant lip product material dispenser of claim 9, wherein the first external threads are right handed threads.

11. The child resistant lip product material dispenser of claim 10, wherein the body further comprises a second opening at a second end and the child resistant lip product material dispenser further comprises:

the end cap having the elongate portion configured to extend into the body through the second opening.

12. The child resistant lip product material dispenser of claim 11, wherein the elongate portion comprises a radially outwardly extending member, wherein an outer dimension of the radially outwardly extending member has a larger dimension than an inner dimension of the second opening, and wherein rotation of the end cap relative to the body translates the guide block axially along the elongate portion.

13. The child resistant lip product material dispenser of claim 12, further comprising lip product material disposed on the guide block.

14. The child resistant lip product material dispenser of claim 8, wherein the lid further comprises an annular skirt depending from the surface of the lid, a free end of the annular skirt comprises a lip that extends radially inward, and an inner radius of the lip has a smaller dimension than an outer dimension of the rotary module.

15. A child resistant lip product material dispenser, comprising:

a body having a first opening at a first end and a second opening at a second end and external threads disposed on an external surface of the body proximate the first end;

an end cap having an elongate portion configured to extend into the body through the second opening, wherein the elongate portion comprises an at least partially externally threaded portion;

a guide block having first internal threads configured to engage with the at least partially externally threaded portion;

a rotary module having second internal threads configured to engage with the external threads; and a lid disposed on the rotary module; wherein the rotary module further comprises a first plurality of spaced teeth arranged in a circular pattern on a surface of the rotary module facing the lid, and the lid comprises a second plurality of spaced teeth arranged in a circular pattern on a surface of the lid facing the rotary module; and wherein the first and second pluralities of spaced teeth are configured to mesh together.

16. The child resistant lip product material dispenser of claim 15, wherein each of the first plurality of spaced teeth comprises a ramped surface facing the lid, wherein each of the ramped surfaces is oriented to face circumferentially clockwise relative to the circular pattern, and wherein the external threads are right handed threads.

17. The child resistant lip product material dispenser of claim 16, wherein the elongate portion comprises a radially outwardly extending member, wherein an outer dimension of the radially outwardly extending member has a larger dimension than an inner dimension of the second opening, and wherein rotation of the end cap relative to the body translates the guide block axially along the elongate portion.

18. The child resistant lip product material dispenser of claim 17, further comprising lip product material disposed on the guide block.

19. The child resistant lip product material dispenser of claim 15, wherein the lid further comprises an annular skirt depending from the surface of the lid, a free end of the annular skirt comprises a lip that extends radially inward, and an inner radius of the lip has a smaller dimension than an outer dimension of the rotary module.

* * * * *